United States Patent [19]

Oehlert

[11] 4,266,385

[45] May 12, 1981

[54] INTERLOCKING BUILDING PANEL CONSTRUCTION

[76] Inventor: James A. Oehlert, P.O. Box 5026, Longview, Tex. 75604

[21] Appl. No.: 44,580

[22] Filed: Jun. 1, 1979

[51] Int. Cl.[3] ..... E04D 3/361

[52] U.S. Cl. ..... 52/521; 52/588; 52/543

[58] Field of Search ..... 52/521, 538, 543, 588, 52/529, 531

[56] References Cited

U.S. PATENT DOCUMENTS

| | | | |
|---|---|---|---|
| 422,571 | 3/1890 | Cooper | 52/529 |
| 762,939 | 6/1904 | Pioch | 52/531 |
| 1,110,272 | 9/1914 | Probert | 52/529 |
| 2,148,434 | 2/1939 | Calkins et al. | 52/531 |
| 3,085,367 | 4/1963 | De Ridder et al. | 52/588 |
| 3,524,292 | 8/1970 | Bottom | 52/588 |
| 3,733,767 | 5/1973 | Craik | 52/586 |
| 3,759,007 | 9/1973 | Thiele | 52/588 |
| 3,898,783 | 8/1975 | Matlock et al. | 52/588 |
| 4,014,152 | 3/1977 | Vallee | 52/588 |
| 4,091,588 | 5/1978 | Heirich | 52/588 |

FOREIGN PATENT DOCUMENTS

| | | | |
|---|---|---|---|
| 1336774 | 7/1963 | France | 52/529 |
| 678250 | 12/1964 | Italy | 52/588 |

*Primary Examiner*—James L. Ridgill, Jr

[57] ABSTRACT

An interlocking building panel construction for the facia and roof portions of building structures wherein the fasteners for securing the panels to the building structure are positioned within enclosed batten channels and are protected from the external environment. Each panel structure includes an intermediate section for spanning the building supports and opposed interlocking edge portions. The edge portions of adjacent panel structures interlock in such manner as to define a substantially sealed, water tight batten channel that conceals and protects the fasteners and renders the joined panels structurally self-sufficient through effective distribution of loads.

7 Claims, 7 Drawing Figures

INTERLOCKING BUILDING PANEL CONSTRUCTION

FIELD OF THE INVENTION

This invention relates generally to building panel structures such as are typically composed of metal or plastic sheet materials and, more particularly, the invention relates to an interlocking panel construction that may be effectively utilized for both roof and facia building panels and which panels are interlocked with adjacent panels during assembly of the same to the building structure.

BACKGROUND OF THE INVENTION

Building panels for attachment as roof and facia portions of building structures are manufactured and utilized in many different forms. One building panel form that has gained wide acceptance in the building industry is a building panel structure that simulates the board and batten type building structure because of the pleasing aesthetic appearance thereof. In the past, many building panel structures have been designed that are adapted to be placed in interlocking relationship with adjacent building panels, thus properly orienting the building panel structures relative to one another. Many building panel structures that are acceptable for utilization as facia to define the walls of buildings are not suitable as roof panels because of the inability of such structures to provide adequate protection against leakage of water during rains. Further, many building panel structures are designed particularly for aesthetic appearance and interlocking relationship but do not provide for the development of structurally self-sufficient wall and roof portions that will support uniformly distributed loads without any additional structure other than that required at fastener intervals.

Accordingly, it is a primary feature of the present invention to provide a novel building panel structure having an intermediate portion and side edge portions that are adapted to be placed in interlocking relationship during attachment of the same to a building structure.

It is also a feature of the present invention to provide a novel building panel structure wherein cooperating interlocking side edge portions thereof establish a board and batten appearance of aesthetically pleasing character.

It is another feature of this invention to provide a novel building panel structure such as might be composed of sheet metal, plastic sheet or any other suitable material, and which, when interlocked with adjacent building panel structures, develops water tight integrity at the joint with adjacent building panels, thus providing for efficient utilization of such panels as roof and facia structures of buildings.

Among the several features of this invention is contemplated the provision of a novel roof building panel structure wherein the structural interconnection established between adjacent interlocked building panels is structurally self-sufficient and will support uniformly distributed loads without any additional structure other than that required at panel fastener intervals.

It is an even further feature of this invention to provide a novel building panel structure that may be effectively utilized in the development of high or low pitched roofs without any risk of leakage at the joints between the building panels.

Other and further objects, advantages and features of the invention will become obvious to one skilled in the art upon an understanding of the illustrative embodiment about to be described and various advantages not referred to herein will occur to one skilled in the art upon employment of the invention in practice.

THE PRIOR ART

Interlocking building panel structures are well known in the art as exemplified by the following U.S. patents: U.S. Pat. No. 4,091,588 illustrates an interlocking panel relationship wherein the panel fasteners are concealed within channels defined by the interlocking panel structures. U.S. Pat. No. 3,759,007 illustrates an interlocking panel arrangement wherein an interlocking relationship is established by a panel edge portion that is received within an elongated channel. Further interlocking panel structures are evident from the teachings of U.S. Pat. Nos. 3,524,292; 3,733,767; 3,085,367; and 3,898,783. Roof panel structures of interlocking relationship are taught by U.S. Pat. No. 4,014,152 with the cooperating panel structures defining a board and batten type structural interconnection for aesthetic appearance.

SUMMARY OF THE INVENTION

The present invention is directed to the provision of a building panel construction that is equally applicable for utilization as the facia or roof portion of building structures and which provides an aesthetically pleasing board and batten character when the interlocking panels are assembled. Each of the panel structures defines an intermediate portion which may be of substantially planar configuration or of any other suitable configuration as desired and with interlocking side edge portions defined on each side of the intermediate panel portion. One of the side edge portions is formed outwardly away from the intermediate portion of the panel and is further formed to define an inclined channel wall and a protective outer wall that is positioned in substantially parallel relation with the intermediate portion of the panel and defines the outer surface of the batten. At one side edge of the protective outer portion, the panel is reverse rolled in such manner as to define an elongated interlocking receptacle of arcuate cross-sectional configuration and with the opposite side of the protective outer portion of the panel structure being formed to an aesthetically pleasing curved appearance.

The opposite interlocking edge portion of the panel is formed to define an inclined wall portion having an interlocking edge flange being defined at the free extremity thereof. The material of the panel structure is reverse bent and formed upon itself in such manner as to define a double wall structure and to present a fastener wall that is substantially coplanar with the intermediate portion of the panel. The fastener is adapted to receive fasteners such as nails, screws or other fastening devices to secure the edge portion of the panel structure to the roof or wall support structure of the building.

The batten side walls defined by interlocking adjacent building panel structures are each inclined at an angle of less than 90° with respect to the intermediate portion of the particular panel involved and cooperate with the fastening wall and with the outer protective wall structure in such manner as to define an elongated batten channel of generally truncated triangular configuration. This truncated triangular configuration promotes the development of a ridged panel support channel structure that renders the panel structurally self-sufficient and promotes the ability of the assembled panels to support uniformly distributed loads without any additional structure other than that required at fastener intervals.

The assembled edges of adjacent panels define only a single joint at which leakage might occur and that joint is positioned in substantially spaced relation from the plane defined by the adjacent panels. Leakage of water at the joint is effectively precluded by positioning of the single joint in spaced relation to the intermediate portion of the panel. Upon assembly of adjacent edge portions of panels into interlocking assembly, the spaced edge portion of the interlocking receptacle is oriented in such manner that it comes into contact with a corner portion defined by the relationship of the interlocking edge portion to the respective side wall portion of the batten channel. When this interlocking relationship occurs, the side wall portion becomes slightly stressed and tight engagement occurs between the edge portion defined by the receptacle and the edge engaging corner of the interlocking flange portion. This feature effectively provides water tight integrity at the single joint between the panels and thus negates any need whatever for additional sealing elements that might otherwise be required to ensure the maintenance of proper water tight sealing engagement between the panel structures.

The invention may take other convenient forms with the following attributes of the invention being common to each embodiment thereof: The joint between the panels is located a substantial distance from the plane established by the body or intermediate portions of the panels. A fastening wall is defined that is substantially coplanar with the body or intermediate portions of the panels and is positioned with respect to other panel structure that the fastening devices are concealed and protected from the external environment. Panel interlocking is accomplished by a reverse rolled panel edge that defines a locking receptacle and a double walled structure that defines a locking flange that is receivable within the locking receptacle. The edge portion of the locking receptacle is adapted to be mechanically urged into tight engagement within a corner defined by the locking flange and the panel wall from which the locking flange is formed. A locator flange is also provided by the panel structure that facilitates proper orientation of the panels during assembly.

BRIEF DESCRIPTION OF THE DRAWINGS

In order that the manner in which the above-recited advantages and objects of the invention are attained and can be understood in detail, more particular description of the invention may be had by reference to the specific embodiment thereof that is illustrated in the appended drawings, which drawings form a part of this specification. It is to be understood, however, that the appended drawings illustrate only a typical embodiment of the invention and are therefore not to be considered limiting of its scope, for the invention may admit to other equally effective embodiments.

IN THE DRAWINGS

Figure 1:
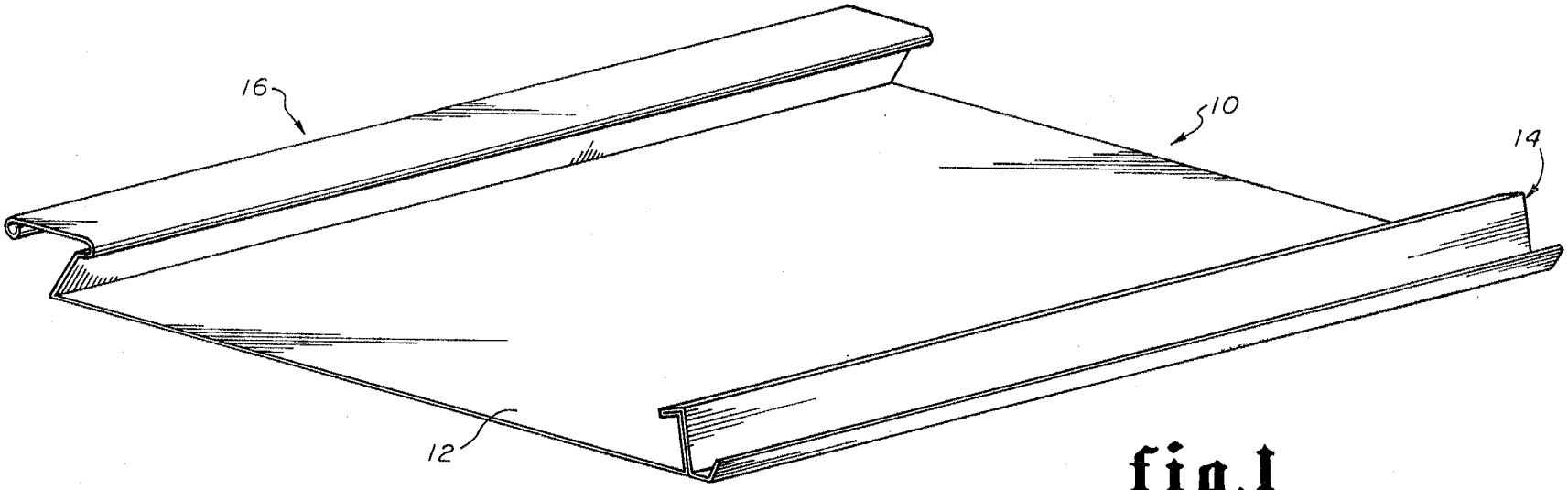

FIG. 1 is an isometric view illustrating a building panel structure constructed in accordance with the teachings of the present invention.

Figure 2:
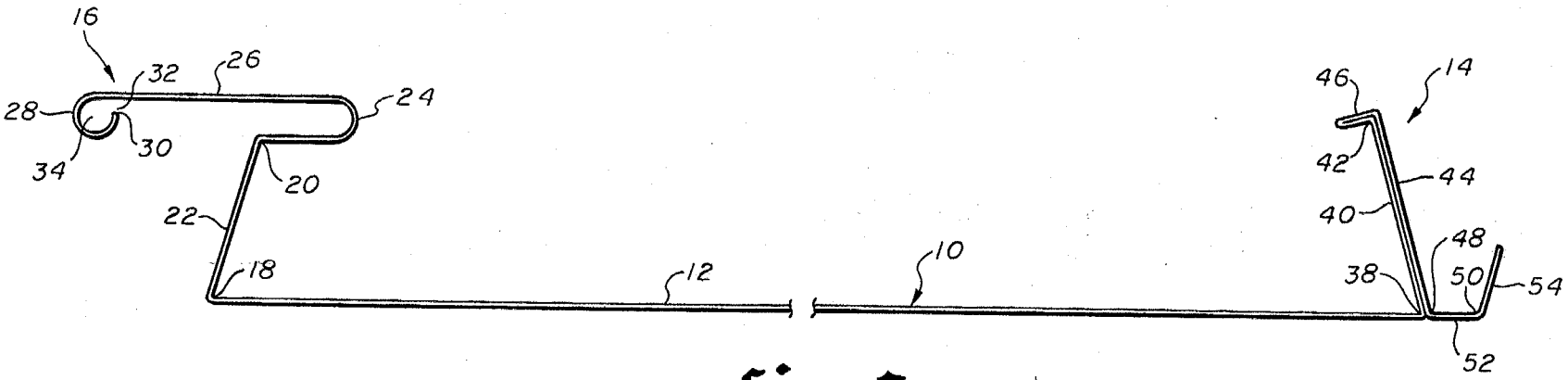

FIG. 2 is a sectional view of the building panel structure of FIG. 1.

Figure 3:
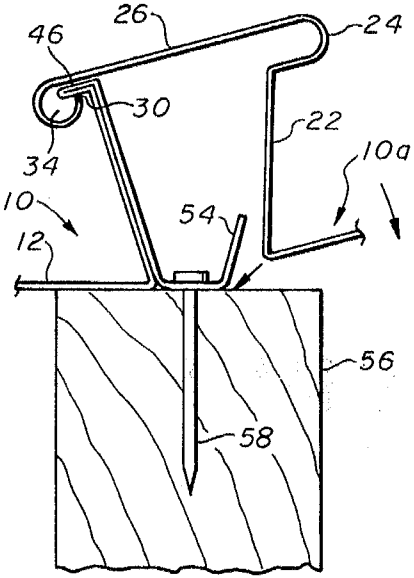

FIG. 3 is a fragmentary sectional view of a pair of building panel structures, illustrating assembly of the building panel structures into joined, interlocking relationship.

Figure 4:
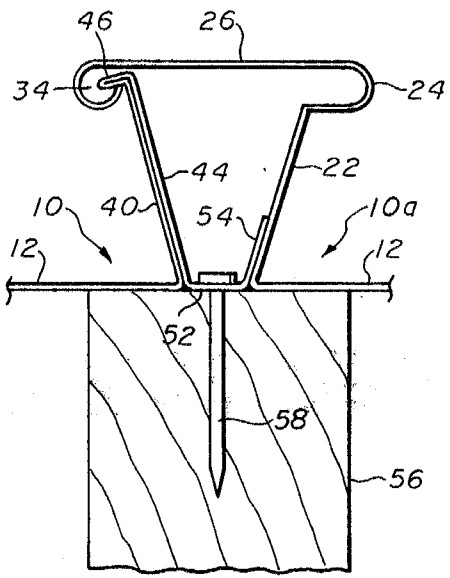

FIG. 4 is a fragmentary sectional view of a pair of building panels such as shown in FIGS. 1 and 2 with the building panel structures being joined in interlocking relationship.

Figure 5:
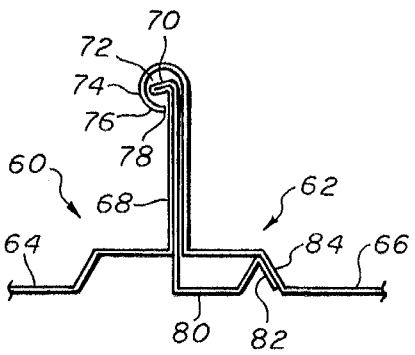

FIG. 5 is a partial isometric end view of joined building panels representing a modified embodiment of this invention.

Figure 6:
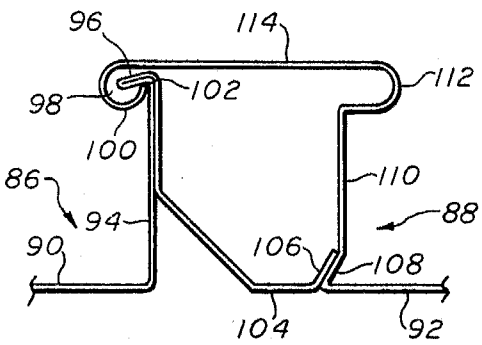

FIG. 6 is a partial isometric end view of joined building panels representing a further modified embodiment of this invention.

Figure 7:
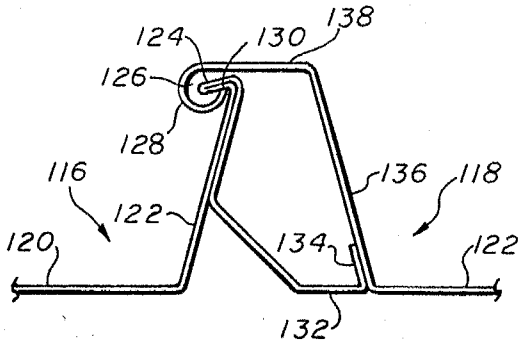

FIG. 7 is a partial isometric end view of joined building panels representing yet another modified embodiment of this invention.

DETAILED DESCRIPTION OF PREFERRED EMBODIMENT

Referring now to the drawings, and first to FIG. 1, a building panel structure is illustrated generally at 10 which includes an intermediate panel portion 12 that is illustrated as being of substantially planar configuration, but which may take any other suitable form as is desired for aesthetic appearance and utility. At opposed sides of the intermediate panel portion 12 is defined integral interlocking side edge portions illustrated generally at 14 and 16 and which are adapted to be interconnected in interlocking mating relationship with respective side edge portions of adjacent building panel structures that are identical with respect to the panel structure 10.

As is evident particularly with respect to FIG. 2, the side edge portion 16 of the panel structure is defined by bending the sheet material from which the panel is composed along a line 18 and again bending the sheet material along a line 20 so as to define a batten channel side wall portion 22. The side wall portion 22 is oriented with respect to the plane of the intermediate portion 12 of the panel such that an angle of less than 90° is established therebetween. The panel material is then reverse bent to form a smoothly curved edge portion 24 that defines one of the side edges of the batten portion of the panel. Edge portion 24 is smoothly transitioned with a substantially planar protective outer wall 26 that is offset from and substantially parallel with the plane established by the intermediate portion 12 of the panel structure. At the free extremity of the panel materal, the material is again reverse bent to define a smoothly curved arcuate portion 28 and to define a free edge portion 30 that is positioned in spaced relation with the protective wall structure 26, thus defining an entry groove 32 into an elongated interlocking receptacle 34.

At the opposite side of the intermediate panel portion 12, the material from which the panel is composed is bent along a line 38 and defines an inclined batten channel wall 40 that is also disposed in angular relation with the plane defined by the intermediate portion of the panel such that an angle of less than 90° is defined. The panel material is then again bent along a line 42 and is reverse bent upon itself in such manner as to define a double wall structure 44. The outer reverse bent portion of the panel defines an interlocking flange 46 that is adapted to enter through the entrance groove 32 into the interlocking receptacle 34 of an adjacent building panel. This interlocking relationship will be discussed hereinabove in connection with FIGS. 3 and 4.

The panel material is further bent along lines 48 and 50 and is formed to define an elongated fastener wall 52 that is disposed in substantially coplanar relation with the plane established by the intermediate portion 12 of the panel. Fastener elements such as nails, screws, or any other suitable fastening means, may be extended through the fastening wall 52 in order to secure the panel structure to the walls or other structural elements of a building structure. The outside edge portion on one side of the panel structure is defined by an inclined locator flange 54 that is inclined with respect to the fastener portion 52 and defines an angular relationship of greater than 90° with respect to the fastener portion. The incline of the locator flange 54 is substantially identical with respect to the incline of the batten side wall portion 22 such that a batten side wall portion of an adjacent building panel may be brought into intimate engagement with the locator flange. This feature establishes proper positioning of building panels relative to adjacent building panel structures and insures the development of properly oriented, interlocked and sealed connection that defines the batten structure. These batten structures, as indicated above, provide adequate protection against any leakage of water through the joint between adjacent panels, provide efficient structural integrity for the panels and renders them capable of supporting uniformly distributed loads. The batten structures also negate any need for additional fastener elements such as clamps, thus minimizing labor and material costs during building construction.

Referring now to FIGS. 3 and 4, a building panel structure according to this invention is secured to the wall or framework structure 56 of a building under construction by means of fasteners 58 such as might conveniently take the form of nails, screws or any other suitable fastener elements. The fastener elements will be inserted through the fastener wall portion 52 of the panel 10 and several of the fasteners will be utilized along the length of the grooves defined by the relationship of the double side wall 40–44 and the locator flange 54. With the panel 10 secured in place in this manner, an adjacent identical building panel **10*a* will be brought into assembly with panel 10 first by orienting panel 10*a* in angular relationship with panel 10 in the manner illustrated in FIG. 3. With the panel 10*a* oriented in this manner, panel 10*a* is moved transversely, thereby causing the interlocking flange 46 of panel 10 to be inserted through the space 32 defined between the free edge 30 of the rolled edge portion 28 of the batten structure. The interlocking flange 46 is thus inserted into the elongated interlocking receptacle 34 thus positioning the free edge portion 30 in close proximity to the corner 42 that is defined between the interlocking flange and the double side wall 40–44. After this has been accomplished, the panel 10*a* is then pivoted about the interconnected interlocking flange and receptacle thereby causing one end portion of the side wall 22 to move into intimate abutting relationship with the locator flange 54. After such positioning of panel 10*a* has been accomplished, the fastener wall 52 at the opposite side of panel 10*a* will be disposed in engaging relation with the wall or framework of the building structure. Fastener elements such as shown at 58 in FIGS. 3 and 4 may then be inserted through the fastener wall 52 of panel 10*a*, thereby securing it in place with respect to the building structure. The panel elements, thus positioned, will effectively define a batten structure of pleasing appearance that will present a joint only along the free edge 30, which free edge is positioned a substantial distance from the plane established by the intermediate section 12 of the panel. This structural feature effectively prevent leakage of water at the joint between the panels even though the pitch of a building roof might be quite low. For example, in a particular panel design, the spacing of the batten joint from the intermediate portion 12** of the panel will be in the order of $1\frac{1}{4}$ inches and thus the depth of water on the panels must exceed this particular dimension before any possibility of leakage exists.

As the panel **10*a* is pivoted with respect to panel 10 during assembly, as shown in FIG. 3, the free edge 30 will be forced tightly into the corner defined between the interlocking flange 46 and the double side wall 40–44 of the batten structure. The double side wall 40–44 will be slightly under this condition, thus urging the interlocking flange into the corner 42. The free edge 30 therefore becomes forced tightly into the corner 42** and thereby provides an effective seal to prevent leakage of water into the batten channel structure.

When adjacent panels 10 and **10*a* are positioned in assembled relation as illustrated in FIG. 4, and one of the panels is secured to the structural framework of a building, the double side wall portions 40–44 of the panel batten structure and side wall portion 22 cooperate with the protective cover portion 26 and the fashioner wall structure 52 to define elongated batten structural elements that are of generally triangular cross-sectional configuration. More specifically, the cross-sectional configuration is that of a truncated triangle. This particular batten configuration lends significant structural strength to the panel structures, thereby rendering the interlocked panels structurally self-sufficient. The panels will support uniformly distributed loads without any additional structure other than that required at fastener intervals. Moreover, the fasteners 58** that secure the panel structures in assembly with the wall or framework structure of a building, will be located in concealed manner within the elongated channels that are defined within the batten structures. This features prevents the necessity for providing any form of sealing element about the fasteners themselves in order to prevent leakage that might otherwise occur if the fastener elements were exposed.

The exterior configuration presented by the batten structures themselves are of simple and pleasing appearance since the protective cover structure 26 includes gently curved side edges defined by curved surfaces 24 and 28.

It will be evident from FIGS. 5, 6 and 7 that the present invention may take other convenient forms within the spirit and scope of the present invention. The panel and panel joint structure illustrated in FIG. 5 provides a standing seam effect at the panel joint that is applicable particularly for roof panel structures but which is also applicable to facia panel structures as well. As illustrated in FIG. 6, another embodiment of the invention provides a standard board and batten effect while utilizing the interlocking panel joint concept of the present invention. Further, as shown in FIG. 7, the panel joint structure that is defined presents a tapered, high rib effect that is particularly applicable to provide the facia portions of sheet metal building structures.

Referring now particularly to FIG. 5, joined panels illustrated generally at 60 and 62 are shown by way of a fragmentary isometric view wherein the panels include intermediate body portions 64 and 66 each having edge portions that mate in cooperative manner to define an interlocked panel joint. One edge of panel 60 is formed to define a double upstanding wall structure 68 by bending the sheet material back on itself. At the upper extremity of the double wall structure 68 is formed an interlocking flange 70 that is receivable within an interlocking receptacle 72 defined by a reverse rolled edge portion 74 of the adjacent panel 62. The edge 76 of panel 60 is adapted to be received in tight mechanical engagement within a corner 78 defined by the upstanding double wall 68 and the interlocking flange 70.

The edge portion of the panel 60 is extended and is formed laterally so as to define a fastening portion 80 that is substantially coplanar with the intermediate portions 64 and 66 of the adjacent panels. Fastener elements such as nails, screws or other fastening devices are received by the fastening surface 80 and function to secure the panel structure in assembly with the framework or wall structure of a building construction. The outside edge portion of panel 60 is also formed to define a locator element 82 that will be engaged by a locator surface 84 defined by a portion of the adjacent panel 62. The joint between panels 60 and 62 develop a standing seam effect that is especially applicable for utilization as the roof panels of a building structure. The joint that is established between panels 60 and 62 is interlocked in such manner as to develop a water-tight joint. Moreover, the joint is located in substantially spaced relation with the plane established by the intermediate portions 64 and 66 of the panel structures and therefore may be effectively utilized in roof structures of quite low pitch. This panel structure is also capable of being effectively utilized as the wall or facia portion of building structures within the scope of this invention.

The panel and panel joint structure illustrated in FIG. 6 defines a standard board and batten effect that may be effectively utilized as a low wide board and batten structure for the wall panels or facia portions of building structures. This panel structure is also capable of being utilized as roof panels within the spirit and scope of the present invention. Panels illustrated generally at 86 and 88 each define intermediate or body portions 90 and 92 and define mating interlocking edge portions that cooperate to establish a sealed batten joint that is capable of being interlocked in accordance with the present invention. One edge portion of panel 86 is formed to define an upstanding wall structure 94 that is doubled at the upper portion thereof by folding the sheet material back upon itself. The outer portion of this doubled wall structure is formed to define an interlocking flange 96 that is capable of being received within an interlocking receptacle 98 defined by a reverse roll defined by the edge portion of adjacent panel structure 88. The interlocking flange 96 is formed to define a corner 102 that receives the edge portion of the adjacent panel 88 in tight mechanical engagement therebetween so as to develop a sealed joint that prevents leakage of water at the joint between the panels. Moreover, the sealed joint is concealed by the reverse rolled portion 100 of panel 88 and therefore, like the structure illustrated in FIG. 5, develops a panel assembly of pleasing appearance.

The double wall portion of panel 86 is tapered downwardly and is formed to define a fastener surface 104 through which fastener elements may extend in order to secure the panel to the framework or wall structure of a building. The edge portion of panel 86 is then formed in an upwardly inclined manner and defines a locator flange 106 that cooperates with a mating inclined locator portion 108 of panel 88 in order to establish accurate positioning of the panels during assembly. The edge portion of panel structure 88 is also formed to define a side wall 110 of the board and batten joint structure and is further formed to define a rolled edge 112 that is similar to the opposite rolled edge portion 100 and is smoothly transitioned with respect to a protective outer batten wall structure 114.

As illustrated in FIG. 7, a panel and panel joint structure is defined that presents a high rib effect that is particularly designed for utilization as the facia portion of a building structure. Adjacent panels illustrated generally at 116 and 118 incorporate intermediate or body portions 120 and 122 that are adapted to be positioned in substantially coplanar relation when in assembly. Panel 116 is formed to define a rib wall structure 122 that incorporates a portion thereof formed back upon itself and defining a double wall structure. The outer portion of the double wall structure is formed to define an interlocking flange 124 that may be received within an interlocking receptacle 126 defined by a reverse rolled edge portion 128 of panel 118. Here again, the cooperative relationship between the double wall structure and the interlocking flange structure defines a corner 130 within which the edge portion of panel 118 is received in tight mechanical engagement in order to develop a water tight joint that is concealed and protected by the interlocking flange and receptacle assembly. The double walled portion of panel 116 is extended to the plane established between intermediate portions 120 and 122 of panels 116 and 118 and defines a fastening wall structure 132 through which fastening elements may extend in order to secure the edge portion of the panel 116 in assembly with the framework or wall of the building structure. The edge portion of panel 116 is further formed to define a locator flange 134 that is oriented in angular relation with respect to the plane defined by the intermediate portions of the panels and establishes mating locating engagement with an inclined outer wall structure 136 of panel 118. Panel 118 is further formed to define a protective outer wall portion 138 of the high rib panel joint structure.

In the case of each of the panel and panel joint structures illustrated in FIGS. 5, 6 and 7, a number of features are common to each of these panel joint structures and with the panel joint structure illustrated in FIGS. 1–4. The joint between each of the panel structures is located a substantial distance from the plane established by the body or intermediate portions of the panels. A fastening wall is defined that is substantially coplanar with respect to the plane of the body or intermediate portions of adjacent panels and is positioned with respect to other panel structures such that fastening devices that secure the panels to the wall structure or roof structure of a building are concealed and protected from the external environment. Panel interlocking is accomplished by a reverse rolled panel edge that defines an interlocking receptacle and a double wall structure that defines a locking flange that is receivable within the locking receptacle. The edge portion of the locking receptacle is adapted to be mechanically urged into tight, mechanically sealed engagement with a corner defined by the locking flange and the panel wall from which the locking flange is formed. A locator flange is also provided by the panel structure that facilitates proper orientation of the panels during assembly.

In view of the foregoing, it is apparent that I have provided a novel interlocking panel structure for defining the roof and facia portions of building structures. The interlocking relationship of the panels which is defined by the unique batten connection portions of the panel structures defines a water tight assembly that is effective for utilization in both high and low pitched roofs and is also effective for utilization as the facia portions of buildings without any risk of water leakage. The water tight integrity of the interlocked and assembled panel structures negates any need whatever for usual neoprene washers or other sealing devices about fastener devices or at the joint between the panels, thus effectively minimizing labor and material costs for building structures. The panels are capable of being interlocked and, when properly positioned, the interlocked batten structure is both self-locking and structurally sound. The self-locking principle negates any need for additional fasteners such as clamps, thus further reducing labor and material costs for building structures. An important feature of the invention concerns the structural integrity that is established by the interlocking batten structures which effectively promote the development of structurally self-sufficient roof and facia surfaces of buildings. The interrelated panel structures effectively provide for uniform distribution of loads without any additional structure other than the support that is required at fastener intervals.

It is therefore apparent that the present invention is one well adapted to attain all of the objects and advantages hereinabove set forth together with other advantages which will become obvious and inherent from a description of the apparatus itself. It will be understood that certain combinations and subcombinations are of utility and may be employed without reference to other features and subcombinations. This is contemplated by and is within the scope of the present invention.

As many possible embodiments may be made of this invention without departing from the spirit or scope thereof, it is to be understood that all matters hereinabove set forth or shown in the accompanying drawings are to be interpreted as illustrative and not in any limiting sense.

What is claimed is:

1. An interlocking building panel construction comprising:

an intermediate panel portion;

first and second batten portions being defined at respective sides of said intermediate panel portion and adapted for interlocking mating relation with the batten portions of adjacent building panels;

said first batten portion being formed to define a first batten channel side wall extending in transverse relation to said intermediate panel portion and an outer protective channel wall being in offset relation with said intermediate portion, said first batten portion further defining an elongated interlocking receptacle arcuately curved inwardly from said protective channel wall and having an upwardly facing edge shaped apart from the inside of said outer protective channel wall;

said second batten portion being formed to define a second batten channel side wall and an interlocking flange, said interlocking flange being formed back from said second batten side wall to form a corner therebetween, said interlocking flange being adapted to extend between said edge and said inside of said outer protector channel wall into said interlocking receptacle with said corner receiving said edge to form a substantial seal therewith, said second batten portion further defining a fastening wall being substantially coplanar with said intermediate panel portion.

2. An interlocking building panel construction as recited in claim 1, wherein:

said second batten portion is further formed to define a locator flange extending in angular relationship with said intermediate portion of said panel; and said first batten channel side wall of said adjacent panel being positionable in intimate abutting and located relation with said locator flange upon assembly of said panels.

3. An interlocking building panel construction as recited in claim 2, wherein:

said locator flange cooperates with said second batten side wall and said fastener wall to define an elongated fastener channel, said fastener means being positionable in protected relation within said fastener channel.

4. An interlocking building panel construction as recited in claim 1, wherein:

said panel construction is formed of sheet material; and said first and second batten channel side wall portions form an angle of less than 90° with respect to said intermediate panel portion.

5. An interlocking building panel construction as recited in claim 2, wherein:

said outer protective channel wall being of greater dimension as compared to the dimension of said fastening wall.

6. An interlocking building panel construction as recited in claim 2, wherein:

said second batten channel side wall is defined by folding sheet material back on itself and forming a side wall of double thickness.

7. An interlocking building panel construction as recited in claim 6, wherein:

said fastener wall is integral with said second side wall.

* * * * *